United States Patent [19]

Oda et al.

[11] Patent Number: 4,655,887

[45] Date of Patent: Apr. 7, 1987

[54] PROCESS FOR ELECTROLYZING AQUEOUS SOLUTION OF ALKALI METAL CHLORIDE

[75] Inventors: Yoshio Oda; Takeshi Morimoto; Kohji Suzuki, all of Yokohama, Japan

[73] Assignee: Asahi Glass Company, Ltd., Tokyo, Japan

[21] Appl. No.: 294,632

[22] Filed: Aug. 20, 1981

[30] Foreign Application Priority Data

Aug. 28, 1980 [JP] Japan ..... 55-117695

[51] Int. Cl.[4] ..... C25B 1/14

[52] U.S. Cl. ..... 204/98; 204/128; 204/283; 204/296

[58] Field of Search ..... 204/98, 128, 283, 296

[56] References Cited

U.S. PATENT DOCUMENTS

| | | | |
|---|---|---|---|
| 4,035,254 | 2/1975 | Gritzner | 204/98 |
| 4,135,996 | 1/1979 | Bouy et al. | 204/98 |
| 4,224,121 | 9/1980 | Dempsey et al. | 204/98 |

FOREIGN PATENT DOCUMENTS

| | | | |
|---|---|---|---|
| 52-89589 | 7/1977 | Japan | 204/98 |
| 53-11199 | 2/1978 | Japan | 204/98 |
| 54-97600 | 8/1979 | Japan | 204/98 |
| WO79/00688 | 3/1978 | PCT Int'l Appl. | 204/98 |
| 2029858 | 3/1980 | United Kingdom | 204/98 |

*Primary Examiner*—R. L. Andrews

*Attorney, Agent, or Firm*—Oblon, Fisher, Spivak, McClelland & Maier

[57] ABSTRACT

An aqueous solution of an alkali metal chloride is electrolyzed by feeding said aqueous solution of an alkali metal chloride into an anode compartment and feeding an oxygen-containing gas in a cathode compartment in an ion exchange membrane cell comprising said anode compartment and said cathode compartment formed by partitioning an anode and a cathode with an ion exchange membrane to which a gas and liquid permeable porous layer made of inorganic particles having no anodic activity and a thickness thinner than the thickness of said ion exchange membrane is bonded and said cathode is an oxygen-reducing cathode.

9 Claims, 1 Drawing Figure

PROCESS FOR ELECTROLYZING AQUEOUS SOLUTION OF ALKALI METAL CHLORIDE

BACKGROUND OF THE INVENTION

1. Field of the Invention

The present invention relates to a process for electrolyzing an aqueous solution of an alkali metal chloride. More particularly, it relates to a process for producing an alkali metal hydroxide by electrolyzing an aqueous solution of an alkali metal chloride in a low cell voltage.

As a process for producing an alkali metal hydroxide by an electrolysis of an aqueous solution of an alkali metal chloride, it has been proposed to use an ion exchange membrane for producing an alkali metal hydroxide having high purity and high concentration instead of the process using an asbestos diaphragm.

On the other hand, it has been proposed to save energy in the world. From the viewpoint, it has been required to minimize a cell voltage in such technology.

It has been proposed to reduce a cell voltage by improvements in the materials, compositions and configurations of an anode and a cathode and compositions of an ion exchange membrane and a kind of ion exchange group.

In these processes, certain advantages can be considered. However, in most of these processes, the maximum concentration of the alkali metal hydroxide is not so high. In the case of higher concentration over the critical concentration, the cell voltage is seriously increased or the current efficiency is remarkably lowered. The maintenance and durability of the low cell voltage phenomenon have not been satisfactory for an industrial purpose.

It has been proposed to attain an electrolysis by a so called solid polymer electrolyte type electrolysis of an alkali metal chloride wherein a cation exchange membrane of a fluorinated polymer is bonded with gas-liquid permeable catalytic anode on one surface and a gas-liquid permeable catalytic cathode on the other surface of the membrane (U.S. Pat. No. 4,224,121).

This electrolytic method is remarkably advantageous as an electrolysis at a lower cell voltage because an electric resistance caused by an electrolyte and an electric resistance caused by bubbles of hydrogen gas and chlorine gas generated in the electrolysis, can be remarkably decreased which have been considered to be difficult to reduce in the conventional electrolysis.

In the process wherein the electrode is bonded to the cation exchange membrane, it is important how to smoothly and satisfactorily remove hydrogen gas and chlorine gas from the surfaces of the electrodes and cation exchange membrane by an electrolysis.

On the other hand, it has been proposed to decrease a cell voltage by using an oxygen-reduction (depolarized) cathode as the cathode and feeding an oxygen-containing gas such as air to react oxygen with water in the cathode so as to rapidly form hydroxyl ion. This cathode forms hydroxyl ion without generating hydrogen gas which causes higher electric resistance. Moreover, it has been proposed to produce an alkali metal hydroxide by bonding a liquid and gas permeable anode on one surface of the ion exchange membrane and using the oxygen-reduction cathode as a counter electrode. (U.S. Pat. No. 4,191,618).

In accordance with the process, the further decrease of a cell voltage is expected. It has been found that when the anode is directly brought into contact with the surface of the ion exchange membrane, the anode is directly brought into contact with hydroxyl ions reversely diffused from the cathode compartment, whereby high alkali resistance is required together with the chlorine resistance. Thus a special expensive substrate must be used for the anode. The life of the electrode is quite different from the life of the ion exchange membrane. When they are bonded, both of them are wasted in the life of one substrate. When an expensive noble metal type anode is used, this disadvantage reduces the advantage of the lower cell voltage.

SUMMARY OF THE INVENTION

It is an object of the present invention to provide a new electrolysis without the above-mentioned disadvantages and to provide a process for electrolyzing an aqueous solution of an alkali metal chloride without bonding an anode to an ion exchange membrane but by placing a gas and liquid permeable porous layer made of inorganic particles having a chlorine overvoltage larger than an anode overvoltage between the ion exchange membrane and the anode, and using a specific cathode.

The foregoing and other objects of the present invention have been attained by providing a process for electrolyzing an aqueous solution of an alkali metal chloride by feeding said aqueous solution of an alkali metal chloride into an anode compartment and feeding an oxygen-containing gas in a cathode compartment in an ion exchange membrane cell comprising said anode compartment and said cathode compartment formed by partitioning an anode and a cathode with an ion exchange membrane to which a gas and liquid permeable porous layer made of inorganic particles having no anodic activity and a thickness thinner than the thickness of said ion exchange membrane is bonded and said cathode is an oxygen-reduction cathode.

BRIEF DESCRIPTION OF THE DRAWING

The FIGURE shows a membrane cell including an anode and a gas and liquid permeable porous layer bonded to the membrane, an oxygen reduction cathode, and various fluid feeding and withdrawal conduits.

DETAILED DESCRIPTION OF THE PREFERRED EMBODIMENTS

Figure 1:
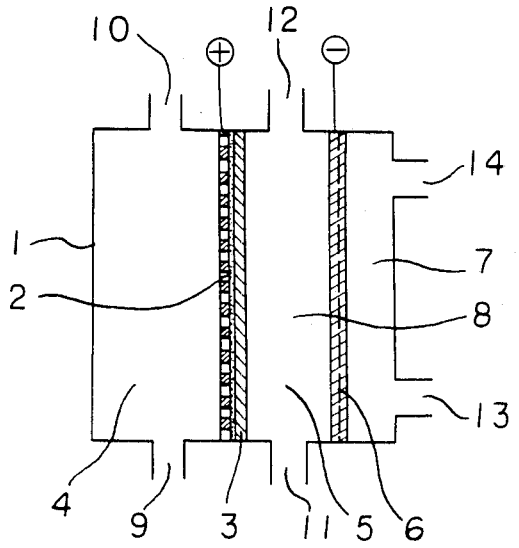

In accordance with the present invention, the anode is placed through the gas and liquid permeable porous layer without direct contact with the ion exchange membrane. Therefore, high alkali resistance is not required for the anode and the conventional anode having only chlorine resistance which have been mainly used can be used. Moreover, the anode need not to be bonded to the porous layer and accordingly, the anode need not to be wasted with the ion exchange membrane in the life of the ion exchange membrane.

In accordance with the present invention, the cell voltage is remarkably low and the cell voltage is further lower than the process for electrolyzing an aqueous solution of an alkali metal chloride in a cell having the anode bonded to a cation exchange membrane. Moreover, the effective reduction of the cell voltage is attained even though the porous layer is made of substantially non-conductive particles. This is unexpected result.

In the present invention, the material for the porous layer having a gas and liquid permeability and higher chlorine overvoltage larger than the anode which is formed in the ion exchange membrane is made of inorganic particles having corrosion resistance under the processing condition. It is preferably made of metals in IV-A Group (preferably Ge, Sn, Pb), IV-B Group (preferably Ti, Zr, Hf), V-B Group (preferably V, Nb, Ta), VI-B Group (preferably Cr, Mo, W) and iron Group (preferably Fe, Co, Ni) of the periodic table, chromium, cerium, manganese, or alloys thereof or oxides, hydroxides, nitrides or carbides of such metal.

In order to form the porous layer from the substance, the particles made of the substance having a particle diameter of 0.01 to 100μ especially 0.1 to 50μ is used, if necessary, the particles are bonded with a suspension of a fluorinated polymer such as polytetrafluoroethylene. A content of the fluorinated polymer is usually in a range of 0.1 to 50 wt.% preferably 0.5 to 30 wt.%. If necessary, a suitable surfactant, a graphite or the other conductive material or additive can be used for uniformly blending them.

An amount of the bonded particles for the porous layer on the membrane is preferably in a range of 0.01 to 50 mg/cm$^2$ especially 0.1 to 15 mg/cm$^2$.

The porous layer formed on the membrane usually has an average pore diameter of 0.01 to 200μ and a porosity of 10 to 99%. It is especially preferable to use the porous layer having an average pore diameter of 0.1 to 100μ and a porosity of 20 to 95% in view of a low cell voltage and a stable electrolysis operation.

A thickness of the porous layer is thinner than the thickness of the ion exchange membrane, and is precisely decided, depending upon the material and physical properties thereof and is usually in a range of 0.1 to 100μ especially 0.5 to 50μ. When the thickness is out of the said range, a desired low cell voltage is not attained or a current efficiency of the present process is disadvantageously inferior. The method of forming the porous layer on the ion exchange membrane is not critical and can be the conventional method described in U.S. Pat. No. 4,224,121 although the material is different. A method of thoroughly blending the powder and, if necessary, a binder or a viscosity controlling agent in a desired medium and forming a porous cake on a filter by a filtration and bonding the cake on the ion exchange membrane or a method of forming a paste from the mixture and directly bonding it on the ion exchange membrane by a screen printing can be also used.

The anode used in the process of the invention can be a porous plate or a net made of a platinum group metal such as Ru, Ir, Pd and Pt or an alloy thereof or an oxide thereof,; or an expanded metal, a porous plate or a net made of titanium or tantalum coated with the platinum group metal or the alloy thereof or the oxide thereof or an anode prepared by mixing a powder made of the platinum group metal, or the alloy thereof or the oxide thereof with a graphite powder and a binder such as a fluorinated polymer and fabricating the mixture in the porous form or the other known anode. It is especially preferable to use the anode prepared by coating the platinum group metal or the alloy thereof or the oxide thereof in an expanded metal made of titanium or tantalum because an electrolysis at a low cell voltage is attained.

When the anode is placed through the porous layer formed on the ion exchange membrane, it is preferable to contact the anode with the porous layer by pushing it since the effect for reducing the cell voltage is highly imparted. It is possible to place the anode without contacting with the porous layer formed on the ion exchange membrane, if desired.

The oxygen-reduction cathode using in the process of the invention is substantially made of a material for catalyzing a reduction of oxygen and a hydrophobic material for preventing leakage of an alkali metal hydroxide and water through the cathode. The cathode is prepared to be gas permeable and preferably has an average pore diameter of 0.01 to 100μ and a porosity of about 20 to 90%. When the average pore diameter or the porosity is less than the low limit of the range, oxygen gas can not be satisfactorily diffused in the cathode to decrease the characteristics. On the contrary, when it is more than the upper limit of the range, the electrolyte is leaked to cause unsatisfactory area of the three phase part in which the electrolyte, the oxygen-reduction accelerator and oxygen gas are simultaneously brought into contact and the mechanical strength of the cathode is too low.

It is preferable to use the cathode having an average pore diameter of 0.05 to 10μ and a porosity of 30 to 85% because the leakage of the electrolyte is prevented, the inner surface area is satisfactory and the effect for diffusing the gas is expected.

In the process of the present invention, a substrate for supporting the important components and maintaining the shape is used for the oxygen-reduction cathode. The substrate is made of nickel, carbon, iron or stainless steel in the gas-permeable form such as a porous plate and a net.

The oxygen-reduction catalyst can be a noble metal such as Pt, pd and Ag; an alloy thereof such as Raney silver; a spinel compound such as $Co.Fe.Al_2O_3$; perovskite type ionic crystal such as $La.NiO_3$ and a transition metal macrocyclic complex such as cobalt phthalocyanine or a mixture thereof. An amount of the oxygen-reduction accelerator (catalyst) is depending upon the kind of the material and is usually in a range of about 0.01 to 200 mg/cm$^2$. When the amount is less than the range, the oxygen-reduction activity is not satisfactorily high in an industrial process whereas when it is more than the range, further additional effect is not expected to cause only higher cost.

It is especially preferable to use it in a range of 0.1 to 100 mg/cm$^2$, because the cost is not so high and the activity is electrochemically satisfactory.

It is especially preferable to use Pt, pd or Ag because the hydroxyl ion forming activity is high enough.

The hydrophobic materials used in the invention have a function for water repellent to prevent the liquid leakage and a function for bonding the oxygen-reduction accelerator and the substrate. It is preferable to use a fluorinated polymer such as polytetrafluoroethylene and polyhexafluoropropylene and a paraffin. An amount of the hydrophobic material is preferably in a range of about 0.002 to 40 mg/cm$^2$. When the amount is less than the range, the liquid leakage is caused or the separation of the oxygen-reduction accelerator is caused, whereas when it is more than the range, the function is too low because of coating of the surface of the oxygen-reduction accelerator by the hydrophobic material. It is especially preferable to be in a range of 0.005 to 30 mg/cm$^2$ because the liquid leakage and the balling-off of the oxygen-reduction accelerator can be prevented and the activity of the accelerator is not substantially lost. It is especially preferable to use polytetrafluoroethylene because of excellent chemical resistance and water repellency. A pore diameter, a number of pores and a diameter of wires are important physical properties of the substrate. It is preferable to be a pore diameter of 0.1 to 20 mm; a number of pores of 1 to 100/cm$^2$; and a diameter of wires of 0.01 to 2 mm.

The effect of the oxygen-reduction accelerator highly depending upon the kind of the material and the particle size. When the particle size is too fine or too rough, the diffusion of air is not satisfactory or the desired number of pores can not be given. It is especially preferable to be in a range of about 0.1 to 50$\mu$. It is preferable for the hydrophobic material to have a particle diameter of 50$\mu$ or less.

The cathode can be prepared by a process for blending a powdery oxygen-reduction accelerator(catalyst) to a suspension of polytetrafluoroethylene and kneading the mixture and coating the mixture on a substrate heating it to a temperature for melting the polytetrafluoroethylene and press-bonding it; or a process for baking carbonyl nickel powder in an inert atmosphere; immersing a solution of the oxygen-reduction accelerator into the resulting porous nickel substrate and treating it for the water repellent treatment with polytetrafluoroethylene; or a process for press-molding a mixture of powders of Raney silver or silver and aluminum, baking the mixture and then dissolving aluminum component to form a porous product; or a combination thereof.

The present invention is not limited to the embodiments described. It is possible to add a perforating agent such as a chloride or carbonate to give a desired porocity to the cathode.

The electrolytic cell used in the present invention can be monopolar or bipolar type in the above-mentioned structure. The electrolytic cell used in the electrolysis of an aqueous solution of an alkali metal chloride, is made of a material being resistant to the aqueous solution of the alkali metal chloride and chlorine such as valve metal like titanium in the anode compartment and is made of a material being resistant to an alkali metal hydroxide and hydrogen such as iron, stainless steel or nickel in the cathode compartment.

The process for electrolyzing an aqueous solution of an alkali metal chloride to produce an alkali metal hydroxide, will be illustrated. In FIG. 1, the electrolytic cell (1) is partitioned by the cation exchange membrane (3), on the anode side of which the gas and liquid permeable porous layer (2) is bonded, into the anode compartment (4) and the cathode compartment (5). The cathode compartment (5) is partitioned by the oxygen-reduction cathode (6) into an oxygen-containing gas (air) feeding compartment (7) and a catholyte compartment. The cell has an inlet (9) for an aqueous solution of an alkali metal chloride such as sodium chloride as an electrolyte; an outlet (10) for the depleted solution; an inlet (11) for feeding water into the catholyte compartment (8); an outlet (12) for the resulting alkali metal hydroxide; and an inlet (13) and outlet (14) for the oxygen-containing gas (air).

The oxygen-reduction cathode can be brought into contact with the surface of the ion exchange membrane for the electrolysis as described in U.S. Pat. No. 4,191,618. This process is illustrated by Example 6.

The aqueous solution of an alkali metal chloride used in the present invention is usually an aqueous solution of sodium chloride, however, an aqueous solution of lithium chloride or potassium chloride or the other alkali metal chloride can be used for producing the corresponding alkali metal hydroxide.

The cation exchange membrane on which the porous non-electrode layer is formed, can be made of a polymer having cation exchange groups such as carboxylic acid groups, sulfonic acid groups, phosphiric acid groups and phenolic hydroxy groups. Suitable polymers include copolymers of a vinyl monomer such as tetrafluoroethylene and chlorotrifluoroethylene and a perfluorovinyl monomer having an ion-exchange group such as sulfonic acid group, carboxylic acid group and phosphoric acid group or a reactive group which can be converted into the ion-exchange group. It is also possible to use a membrane of a polymer of trifluoroethylene in which ion-exchange groups such as sulfonic acid group are introduced or a polymer of styrene-divinyl benzene in which sulfonic acid groups are introduced.

The cation exchange membrane is preferably made of a fluorinated polymer having the following units $$\left(CF_2-CXX'\right) \quad \text{(M mole \%)} \qquad \text{(M)}$$

$$\left(CF_2-\underset{\underset{Y-A}{|}}{CX}\right) \quad \text{(N mole \%)} \qquad \text{(N)}$$

wherein X represents fluorine, chlorine or hydrogen atom or —$CF_3$; X' represents X or $CF_3(CF_2)_m$; m represents an integer of 1 to 5.

The typical examples of Y have the structures bonding A to a fluorocarbon group such as $$\left(CF_2\right)_x,\ -O\left(CF_2\right)_x,\ \left(O-CF_2-\underset{\underset{Z}{|}}{CF}\right)_y,$$

$$-CF_2\left(O-CF_2-\underset{\underset{Z}{|}}{CF}\right)_y,\ \left(O-CF_2-\underset{\underset{Z}{|}}{CF}\right)_x\left(CF_2-\underset{\underset{Rf}{|}}{CF}\right)_y \text{ and}$$

$$-O-CF_2\left(\underset{\underset{Z}{|}}{CF}-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or a $C_1$–$C_{10}$ perfluoroalkyl group; and A represents —COOM or —$SO_3M$, or a functional group which is convertible into —COOM or —$SO_3M$ by a hydrolysis or a neutralization such as —CN, —COF, —$COOR_1$, —$SO_2F$ and —$CONR_2R_3$ or —$SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated cation exchange membrane having an ion exchange group content of 0.5 to 4.0 miliequivalenace/gram dry polymer especially 0.8 to 2.0 miliequivalence/gram dry polymer which is made of said copolymer.

In the cation exchange membrane of a copolymer having the units (M) and (N), the ratio of the units (N) is preferably in a range of 1 to 40 mol % preferably 3 to 25 mol %.

The cation exchange membrane used in this invention is not limited to be made of only one kind of the polymer. It is possible to use a membrane made of two kinds of the polymers having lower ion exchange capacity in the cathode side, and laminated membrane having a weak acidic ion exchange group such as carboxylic acid group in the cathode side and a strong acidic ion exchange group such as sulfonic acid group in the anode side.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

The membrane can be reinforced by supporting said copolymer on a fabric such as a woven fabric or a net, a non-woven fabric or a porous film made of said polymer or wires, a net or a perforated plate made of a metal. The weight of the polymers for the blend or the support is not considered in the measurement of the ion exchange capacity.

The thickness of the membrane is preferably 50 to 1000 microns especially 100 to 500 microns.

The porous non-electrode layer is formed on the surface of the ion exchange membrane preferably in the anode side by bonding it to the ion exchange membrane in a form of ion exchange group such as an acid or ester form in the case of carboxylic acid group and $-SO_2F$ group in the case of sulfonic acid group, preferably under heating the membrane.

The present invention will be further illustrated by certain examples and references which are provided for purposes of illustration only and are not intended to limit the present invention.

EXAMPLE 1

10 Wt. parts of 2% aqueous solution of methyl cellulose (hereinafter referred to as MC), 2.5 wt. parts of an aqueous dispersion having 20 wt.% of polytetrafluoroethylene (particle diameter of 1μ) (hereinafter referred to as PTFE) and 5 wt. parts of titanium oxide powder (particle diameter of 25μ or less) were thorughly mixed and kneaded and 2 wt. parts of isopropyl alcohol and 1 wt. part of cyclohexanol were added and the mixture was further kneaded to obtain a paste.

The paste was screen-printed with a polyurethane squeezer by placing a stainless steel screen (200 mesh) having a thickness of 60μ, a screen mask having a thickness of 8μ on one surface of a cation exchange membrane made of a copolymer of $CF_2{=}CF_2$ and $CF_2{=}CFO(CF_2)_3COOCH_3$ having an ion exchange capacity of 1.43 meq/g. dry resin and a thickness of 210μ in a size of 10 cm×10 cm as a printed substrate.

The printed layer on the cation exchange membrane was dried in air to solidify the paste. The titanium oxide layer formed on the cation exchange membrane had a thickness of 20μ, a porosity of 70% and a content of titanium oxide of 1.5 mg/cm². The cation exchange membrane was hydrolyzed and methyl cellulose was dissolved by dipping it in 25 wt.% aqueous solution of sodium hydroxide at 90° C. for 16 hours.

On the other hand, 55 wt.% of a fine silver powder (diameter of about 700 Å), 15 wt.% of a powdery activated carbon and 15 wt.% of nickel formate were thoroughly mixed. To the mixture an aqueous dispersion having 60 wt.% of polytetrafluoroethylene (diameter of 1μ or less; melting point of 327° C.) was added at a ratio of 10 wt.% as polytetrafluoroethylene and 5 wt.% of a powdery polytetrafluoroethylene (diameter of 15μ or less) was further added and the mixture was kneaded. The knead mixture was rolled to form a sheet having a desired thickness.

The resulting sheet was pressed and bonded on a nickel gauge (40 mesh) by a press-molding machine under a pressure of 1000 kg/cm². The product was baked in a nitrogen gas atmosphere at 350° C. for 60 minutes to melt-bond polytetrafluoroethylene so as to improve the water repellency and the bonding property and to thermally decompose nickel formate whereby an electrode having an average pore diameter of 0.6μ a porosity of 56% and a content of silver of 50 mg/cm².

The resulting electrode was used as the cathode, and the titanium oxide layer of the cation exchange membrane was faced to an anode made of metallic titanium coated with ruthenium oxide, in the electrolytic cell shown in FIG. 1. An electrolysis of 25% aqueous solution of sodium chloride was carried out under the condition of feeding air ($CO_2$ was separated) at a rate of 1 liter/min. into a gas feeding compartment and controlling feed rates of the aqueous solution of sodium chloride and water so as to maintain a concentration of sodium hydroxide at 35 wt.% in the cathode compartment at a current density of 20 A/dm². The cell voltage was 2.11 V at the initial period and rised for 0.08 V after 1000 hours. The current efficiency for the production of sodium hydroxide was 93%.

EXAMPLE 2

Instead of the titanium oxide layer, an iron oxide porous layer was formed on the cation exchange membrane in the anode side. A cathode having a content of silver of 50 mg/cm² was prepared by mixing 70 wt.% of silver carbonate for a silver catalyst, 10 wt.% of powdery activated carbon, 15 wt.% of polytetrafluoroethylene (particle diameter of 1μ or less) and 10 wt.% of the powdery polytetrafluoroethylene used in Example 1 by the process of Example 1.

An electrolytic cell was assembled by using them, and an electrolysis was carried out in accordance with the process of Example 1.

The cell voltage at a current density of 20 A/dm² was 2.13 V at the initial period and rised for 0.05 V after 1000 hours. The current efficiency for the production of sodium hydroxide was 94%.

EXAMPLE 3

In accordance with the process of Example 2 except that a tin oxide porous layer was formed by adhereing a tin oxide powder having an average diameter of 5μ without PTFE on the surface of the cation exchange membrane in the anode side at a content of 1 mg/cm² instead of the iron oxide porous layer, an electrolysis was carried out. The result is as follows:

Current Density (A/dm²): 20

Cell Voltage (V): 2.18

The current efficiency for the production of sodium hydroxide at a current density of 20 A/dm² was 93%.

EXAMPLE 4

In accordance with the process of Example 2 except that a zirconium oxide porous layer was formed by adhereing a zirconium oxide powder having an average particle diameter of 5μ without PTFE on the surface of the cation exchange membrane in the anode side at a concentration of 1 mg/cm² instead of the iron oxide porous layer, an electrolysis was carried out. The result is as follows:

Current Density (A/dm²): 20

Cell Voltage (V): 2.27

The current efficiency for the production of sodium hydroxide at a current density of 20 A/dm² was 94%.

EXAMPLE 5

In accordance with the process of Example 2, a cation exchange membrane made of $CF_2{=}CF_2$ and $CF_2{=}CFOCF_2.CF(CF_3)OCF_2{-}CF_2SO_2F$ (ion exchange capacity of 0.87 meq/g dry resin: thickness of 210μ) was used as a cation exchange membrane and a cathode having a content of Pt of 2 mg/cm$^2$ prepared by mixing 85 wt.% of Pt-active carbon powder obtained by supporting 10 wt.% of Pt by reducing chloroplatinic acid on active carbon with formaldehyde, 10 wt.% of polytetrafluoroethylene having particle diameter of 1μ or less and 5 wt.% of the powdery polytetrafluoroethylene used in Example 1 was used as a cathode, an electrolysis carried out. The result is as follows:

Current Density (A/dm$^2$): 20

Cell Voltage (V): 2.31

The current efficiency for the production of sodium hydroxide at a current density of 20 A/dm$^2$ was 94%.

EXAMPLE 6

In accordance with the process of Example 3 except that tin oxide was adhered in the anode side of the cation exchange membrane and a mixture of platinum black and PTFE (Teflon-30J manufactured by E. I. DuPont Co.) (5:1) was adhered at a content of Pt of 3 mg/cm$^2$ in the cathode side and a mixture of carbon black and PTFE (Teflon-30J) (1:1) was press-bonded on it at a thickness of 100μ under a condition of 140° C. and 30 kg/cm$^2$, and the porous layer-membrane-cathode was assembled in the electrolytic cell, an electrolysis was carried out by feeding water from the upper part of the membrane. The result is as follows:

Current Density (A/dm$^2$): 20

Cell Voltage (V): 2.31

The current efficiency for the production of sodium hydroxide at a current density of 20 A/dm$^2$ was 90%.

We claim:

1. A process for electrolyzing an aqueous solution of an alkali metal chloride which comprises feeding sad aqueous solution of an alkali metal chloride into an anode compartment and feeding an oxygen-containing gas in a cathode compartment in an ion exchange membrane cell comprising said anode compartment and said cathode compartment formed by partitioning an anode and a cathode with an ion exchange membrane to which a gas and liquid permeable porous layer made of inorganic particles having no anodic activity and a thickness thinner than the thickness of said ion exchange membrane is bonded on the anode side of said exchange membrane and said cathode is an oxygen-reducing depolarizing cathode.

2. The process according to claim 1 wherein said gas and liquid permeable porous layer is formed by inorganic particles having an average particle diameter of 0.01 to 100μ and has a porosity of 10 to 99% and a thickness of 0.01 to 100μ.

3. The process according to claim 2 wherein said inorganic particles are made of a metal in IV-A group, IV-B group, V-B group, VI-B group and iron group of the periodic table, chromium, cerium, manganese or an alloy thereof, a hydroxide thereof, a nitride thereof or a carbide thereof.

4. The process according to claim 1, 2 or 3 wherein said anode is brought into contact with said porous layer bonded to said ion exchange membrane.

5. The process according to claim 1 wherein said oxygen-reducing cathode comprises a catalyst for accelerating an oxygen reduction and a hydrophobic material.

6. The process according to claim 4 wherein said catalyst for accelerating the oxygen reduction is a noble metal, silver, spinel compound perovskite ionic crystal or a transition metal macrocyclic complex.

7. The process according to claim 5 wherein said hydrophobic material is polytetrafluoroethylene, polyhexafluoropropylene or paraffin.

8. The process according to claim 1, or 5 wherein said oxygen-reduction cathode is brought into contact with one surface of said ion exchange membrane in the cathode side.

9. The process according to claim 1 wherein said ion exchange membrane is a carboxylic acid type or sulfuric acid type cation exchange membrane.

* * * * *